United States Patent [19]

Fuchs

[11] Patent Number: 4,647,021

[45] Date of Patent: Mar. 3, 1987

[54] APPARATUS FOR INTRODUCING FILLING MATERIAL WHICH IS CAPABLE OF FLOW INTO A TAP HOLE DISPOSED IN THE BOTTOM OF A METALLURGICAL VESSEL

[75] Inventor: Gerhard Fuchs, Kehl-Bodersweier, Fed. Rep. of Germany

[73] Assignee: Fuchs Systemtechnik GmbH, Fed. Rep. of Germany

[21] Appl. No.: 783,220

[22] Filed: Oct. 2, 1985

[30] Foreign Application Priority Data

Oct. 16, 1984 [DE] Fed. Rep. of Germany ..... 3437828

[51] Int. Cl.[4] ..... C21C 5/48

[52] U.S. Cl. ..... 266/271; 266/272

[58] Field of Search ..... 266/45, 271, 272, 273, 266/236; 222/590, 591, 597, 598, 600, 601

[56] References Cited

U.S. PATENT DOCUMENTS

| | | | |
|---|---|---|---|
| 3,507,483 | 4/1970 | Resch et al. | 266/236 |
| 4,220,321 | 9/1980 | Brücher | 266/273 |
| 4,523,747 | 6/1985 | Schnitzer et al. | 266/236 |

FOREIGN PATENT DOCUMENTS

| | | | |
|---|---|---|---|
| 8405150 | 5/1984 | Fed. Rep. of Germany . | |
| 0001986 | 1/1984 | Japan | 266/271 |

OTHER PUBLICATIONS

Radex-Rundschau, pp. 187–196.

Iron and Steel Engineer, p. 31, Jul. 1984.

*Primary Examiner*—L. Dewayne Rutledge

*Assistant Examiner*—S. Kastler

[57] ABSTRACT

For the purposes of introducing filling material which is capable of flow into a tap hole which is disposed in the edge region of the bottom of a metallurgical vessel, in particular a smelting furnace, there is provided a filling pipe which is secured to an arm which is pivotable about a pivot means mounted to the wall of the vessel. The pipe can be pivoted from a position outside the vessel through an opening in the wall of the vessel into a filling position in which the intake opening of the pipe is in communication with a container for supplying the filling material and the discharge opening of the pipe is in opposite relationship to the tap hole. The pipe is of a circularly bent configuration around the pivot axis of the arm so that the opening in the wall of the vessel can be kept small.

10 Claims, 1 Drawing Figure

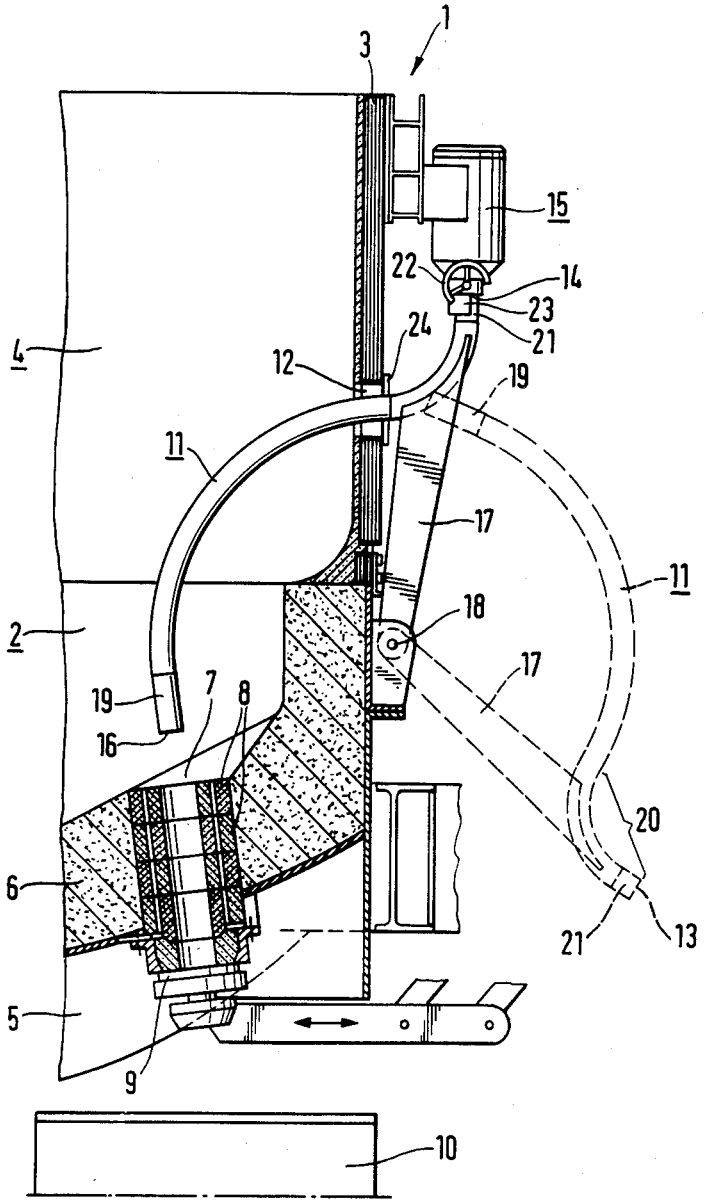
1
3
15
22
14
23
21
24
4
12
19
11
17
11
18
2
17
19
7
8
16
20
6
21
13
5
9
10

APPARATUS FOR INTRODUCING FILLING MATERIAL WHICH IS CAPABLE OF FLOW INTO A TAP HOLE DISPOSED IN THE BOTTOM OF A METALLURGICAL VESSEL

DESCRIPTION

The invention relates to an apparatus for introducing filling material which is capable of flow, into a tap hole which is disposed in the edge region of the bottom of a metallurgical vessel, in particular a smelting furnace.

In a metallurgical vessel with bottom tapping, the tap hole is arranged in the bottom of the vessel and is filled after each tapping operation by means of a filling mass of refractory material, which is capable of flow (see Radex-Rundschau, issue 3, 1980, pages 187 to 196 had German utility model No. 85 05 150). After a closure plate has been fitted to the lower edge of the tap hole, the filling material is introduced by means of a pipe which the steelworker guides to the tap hole through the opening of the charging doors or from an insulated repair capsule which is lowered into the furnace. When dealing with a tap hole which is provided in a portion of the vessel which projects out in the manner of a bay window configuration, the pipe is inserted through an opening in the top of the projecting portion.

The object of the present invention is to automate the operation of introducing the filling material and thereby to reduce the danger of accident, and to reduce the period of time required for the filling operation. The invention seeks to provide a simple guide for the operating movements of the pipe through which the filling material is introduced.

With the apparatus according to the invention, pivotal movement of the pipe which is used for introducing the filling material, about a pivot mounted to the wall of the vessel, causes the pipe to be moved from a position outside of the vessel into a filling position in which the discharge opening of the pipe is in opposite relationship to the tap hole. That pivoting operation is advantageously carried out by means of a pivotal drive. So that the opening in the wall of the vessel, through which the end of the pipe which has the discharge opening has to be introduced into the interior of the furnace, can be kept of minimum size, the pipe, within the region which extends into the vessel in the filling position, is of a circularly bent configuration in the plane of movement thereof, about the pivot axis, that is to say, the axis of the pivot mounting about which the arm is pivotable. However, the pipe should have a short straight portion at the discharge end thereof in order to ensure that the jet of material issuing therefrom is in a defined direction.

Preferably, a metering container is disposed above the opening provided in the wall of the vessel for the pipe to pass therethrough, on the outside of that wall, and the end of the pipe which has the intake opening is bent in such a way that a communication is established between the two openings in the filling position of the pipe. The pivotal movement of the pipe is preferably restricted by an abutment which is mounted on the metering container, and is utilised for actuating a closure member of the metering container and possibly for controlling valves for the feed of a pneumatic conveyor agent for the filling material from the container to the tap hole.

The invention will now be described in greater detail by means of an embodiment with reference to a drawing. The drawing is a diagrammatic view of a part of a longitudinal section of a metallurgical vessel with an apparatus according to the invention.

The accompanying drawing is a view in longitudinal section of a part of a metallurgical vessel 1 which is in the form of an electric arc furnace. The vessel 1 includes a lower vessel portion 2 which has a refractory lining and an upper vessel portion 4 which is formed by water cooling boxes 3. It is supported on a rocking assembly 5 and can be tilted towards the left and towards the right, from the position illustrated, by means of an actuating mechanism. A tap hole 7 is arranged in the edge region of the bottom 6 of the metallurgical vessel on the side towards which the vessel can be tilted by means of the assembly 5. The tap hole 7 is formed in know manner by apertured bricks 8 and is closed at its bottom by a closure plate 9. The closure plate 9 can be moved to the side for example by the mechanism illustrated in German utility model No. 84 05 150 so that the tap hole 7 is open in a downward direction. A ladle 10 is disposed beneath the tap hole 7.

For the purposes of introducing filling material which is capable of flow, into the tap hole 7, the arrangement has a pipe 11 which can be moved from a position shown in broken lines, outside of the vessel 1, through an opening 12 in the wall of the vessel, that is to say, in the illustrated construction in a water cooling box 3, into the filling position which is shown in solid lines. In the filling position, the intake opening 13 of the pipe is connected to a discharge opening 14 of a metering container 15 which supplies the filling material, and the discharge opening 16 of the pipe 11 is in opposite relationship to the tap hole 7. The pipe 11 is pivotally mounted to the outside wall of the vessel 1. For that purpose, the pipe 11 is fixed to an arm 17 which is pivotable about a pivot means 18 mounted to the wall of the vessel. The arrangement has a pivotal drive (not shown) to produce the pivotal motion.

So that the opening 12 in the wall of the vessel can be kept as small as possible, the pipe 11 is curved along a circular arc which is in the plane of the pivotal motion, that is to say, in the plane of the paper in relation to the view illustrated in the accompanying drawing, over almost the entire length of the pipe which extends into the vessel 1 in the filling position thereof. A short straight pipe portion 19 is provided at the discharge end thereof so that the filling material which issues from the pipe in the form of a jet is discharged in a defined direction.

The pipe is curved in the opposite manner in the region 20 which is outside the vessel 1 in the filling position of the pipe, so that its intake opening 13 faces upwardly in the filling position. A short straight portion 21 is also provided at the intake end.

In order to ensure that the pipe does not bend under the effect of the hot atmosphere in the furnace when it is engaged into the vessel 1, it is provided with passages or ducts for a cooling agent and is cooled by means of a coolant which is supplied from the exterior, while the pipe is extended into the vessel 1. The cooling arrangement is not shown for the sake of clarity of the drawing. Desirably, the pipe is of a double-wall construction in order to form cooling ducts and the annular duct between the outside wall and the inside wall of the pipe is used to carry the coolant.

The discharge opening 14 of the metering container 15 can be closed by means of a closure member which can be actuated by a hand wheel 22, the closure member generally being in the form of a flap. Also provided in the region of the discharge opening 14 is an abutment 23 for restricting the pivotal motion of the pipe 11. The abutment 23 is in the form of half a tubular member or an annular portion which receives the straight portion 21 of the end of the pipe in the region of the intake opening 13. Instead of a closure member, which can be actuated by a hand wheel 23, at the lower discharge opening of the metering container 15, the arrangement may also have a closure member which can be actuated by the pivotal motion of the pipe, that is to say, a closure member which is opened automatically when the portion 21 of the pipe 11 passes into the region of the discharge opening 14 of the metering container. Finally, the discharge opening 14 may also be in the form of a pneumatic conveyor nozzle so that the filling material is conveyed into the tap hole 7 not just by the force of gravity but positively by means of a flow of compressed air which is supplied through the conveyor nozzle. In that case, the compressed air feed can be controlled by the hand wheel 22 or by the pivotal motion of the pipe 11.

As long as the pipe 11 is outside the vessel 1, the opening 12 in the wall of the vessel can be closed off from the exterior by a pivotal flap 24.

The mode of operation of the above-described apparatus will now be described:

During the smelting process the pipe is in the position shown in broken lines outside the vessel 1 and the flap 24 closes off the opening 12 from the exterior. Disposed in the tap hole 7 is refractory filling material which prevents the molten bath from coming into contact with the closure plate 9. For the purposes of tapping off the vessel, the vessel is tilted towards the right and the closure plate 9 is moved away from the lower edge of the tap hole 7. When the required amount of liquid metal has been tapped off through the tap hole 7, the vessel 1 is tilted back so that the remaining molten bath and slag contained in the vessel no longer cover the tap hole 7. After the tap hole 7 has been closed off by the closure plate 9, the filling operation, which is carried out by the above-described apparatus, is started.

For that purpose, after the flap 24 has been pushed to one side, the pivotal drive for the arm 17 is operated and the pipe is moved into the filling position as shown in solid lines, the pivotal movement of the pipe being restricted by the abutment 23. In that position, the intake opening 13 of the pipe 11 is in opposite relationship to the discharge opening 14 of the metering container into which the amount of filling material required for filling the tap hole 7 had been previously introduced. The hand wheel 22 is turned to open the discharge opening 14 and compressed air is simultaneously fed to the discharge opening which is in the form of a pneumatic conveying nozzle. The filling material which is capable of flow thus passes through the pipe 11 and into the tap hole 7 in the form of a jet. After the tap hole 7 has been filled, the discharge opening 14 is closed again by means of the hand wheel 22 and the pipe is pivoted back into the position outside the vessel by the pivotal drive. After the opening 12 has been closed by the pivotal flap 24, the filling operation is concluded and the vessel can be tilted back into the position required for the smelting process.

The filling apparatus according to the invention can be used in relation to metallurgical vessels of different types such as electric arc furnaces, holding or annealing furnaces, ladles and the like in which the bottom of the vessel has a tap hole which has to be filled by means of a filling material which is capable of flow, after each tapping operation. In that connection the tap hole may also be provided in a portion of a metallurgical vessel which projects therefrom in a bay window-like configuration.

I claim:

1. Apparatus for introducing filling material which is capable of flow into a tap hole (7) disposed in the edge region of the bottom (6) of a metallurgical vessel (1), comprising a pipe (11) which is movable from a position outside the vessel (1) through an opening (12) in a side wall of the vessel into a filling position in which an intake opening (13) of the pipe (11) communicates with a container (15) for supplying the filling material and a discharge opening (16) of the pipe is in opposite relationship to the tap hole (7) wherein the pipe (11) is fixed to an arm (17) which is pivotable about a pivot means (18) mounted to the outside wall of the vessel (1) and, within the region which in the filling position extends into the vessel (1), the pipe is curved along a circular arc which is disposed in the plane of the pivotal motion and the centre point of which coincides with the pivot axis (18).

2. Apparatus according to claim 1 wherein the arm (17) is provided with a pivotal drive.

3. Apparatus according to claim 1 wherein in the region which is outside the vessel (1) in the filling position, the pipe (11) is curved in such a way that its intake opening faces upwardly in the filling position.

4. Apparatus according to claim 1 wherein the pipe (11) includes ducts for a cooling agent at least in the region which extends into the vessel (1) in the filling position of the pipe.

5. Apparatus according to one of claims 1 to 4 wherein a metering container (15) is disposed above the opening (12) in the wall of the vessel on the exterior thereof, the metering container having a lower discharge opening (14) which is closed by a closure member and which in the filling position communicates with the intake opening (13) of the pipe (11).

6. Apparatus according to claim 5 wherein abutment (23) is associated with the discharge opening (14) of the metering container (15), to limit the pivotal movement of the pipe (11).

7. Apparatus according to claim 6 wherein the abutment (23) is formed as an annular portion which partially receives the end of the pipe in the region of the intake opening (13).

8. Apparatus according to claim 5 wherein the closure member is actuable by the pivotal movement of the pipe (11).

9. Apparatus according to claim 1 wherein, in a metallurgical vessel (1) comprising a lower vessel portion (2) clad with refractory material and an upper vessel portion (4) formed by fluid-cooled wall elements (3), the pipe (11) is pivotally mounted to the lower vessel portion and the opening (12) is provided in the upper vessel portion.

10. Apparatus according to claim 1, wherein said metallurgical vessel (1) comprises a smelting furnace.

* * * * *